US005183473A

United States Patent [19]

Crutchfield et al.

[11] Patent Number: 5,183,473

[45] Date of Patent: Feb. 2, 1993

[54] ENZYME ACTIVATED PEROXYDISULFATE BLEACH COMPOSITION

[75] Inventors: Marvin M. Crutchfield; Bertie J. Reuben, both of St. Louis, Mo.

[73] Assignee: Monsanto Company, St. Louis, Mo.

[21] Appl. No.: 692,098

[22] Filed: Apr. 26, 1991

[51] Int. Cl.[5] ..... C11D 3/395; C11D 7/54; D06L 3/00; D06L 3/02

[52] U.S. Cl. ..... 8/110; 252/95; 252/103; 252/174.12; 252/186.1; 252/DIG. 12

[58] Field of Search ..... 8/110, 95, 103; 252/174.12, 186.1, DIG. 12

[56] References Cited

U.S. PATENT DOCUMENTS

| | | | |
|---|---|---|---|
| 3,666,399 | 5/1972 | Castrantas | 8/111 |
| 3,732,170 | 5/1973 | Demangeon | 252/95 |
| 3,773,673 | 11/1973 | Jenkins et al. | 252/95 |
| 3,781,212 | 12/1973 | Smillie | 252/DIG. 12 |
| 3,957,670 | 5/1976 | Uhl et al. | 252/102 |
| 4,861,509 | 8/1989 | Cornelissen et al. | 252/174.12 |
| 5,108,457 | 4/1992 | Poulose et al. | 252/103 |

FOREIGN PATENT DOCUMENTS

| | | | |
|---|---|---|---|
| 0337274 | 10/1989 | European Pat. Off. . | |
| 0341947 | 11/1989 | European Pat. Off. . | |
| 1033630 | 7/1958 | Fed. Rep. of Germany | 8/110 |
| 213299 | 9/1986 | Japan | 252/DIG. 12 |
| 884748 | 12/1961 | United Kingdom | 8/110 |

OTHER PUBLICATIONS

Afflitto et al., "Effects of Tetrapotassium Peroxydisulfate on Plaque/Gingivitis In Vivo" J. Dental Research, vol. 68, 1988.

*Primary Examiner*—Wayne Langel

*Attorney, Agent, or Firm*—Raymond C. Loyer; Richard H. Shear; James C. Bolding

[57] ABSTRACT

A novel bleach composition is disclosed comprising a sulfatase enzyme and a peroxydisulfate which composition, in aqueous solution, generates the more reactive peroxymonsulfate bleach compound. Detergent compositions and bleach processes are also disclosed wherein the peroxymonsulfate is produced in situ to provide bleach functions with greatly reduced dye damage, particularly useful to remove blood stains from textile materials.

27 Claims, No Drawings

ENZYME ACTIVATED PEROXYDISULFATE BLEACH COMPOSITION

FIELD OF THE INVENTION

The present invention relates to a novel bleach composition. More specifically, this invention relates to a bleach composition comprising a sulfatase enzyme and a peroxydisulfate which composition, in aqueous solution, generates the more reactive peroxymonosulfate bleach compound.

BACKGROUND OF THE INVENTION

Hydrogen peroxide and other inorganic percompounds, in particular perborates and percarbonates, are active oxygen containing substances which are used for bleaching and for the simultaneous washing and bleaching of textile materials. These compounds typically have little bleaching activity at temperatures below about 60° C.

Other known types of inorganic bleaching agents, which are more effective at temperatures below 60° C., include persulfuric acid (sometimes known as Caro's Acid) and its salts and acid salts, and mixed salts, such as Oxone (trade name) which consists essentially of the compounds $KHSO_4$, $K_2SO_4$ and $2KHSO_5$.

Peroxydisulfates, such as $K_2S_2O_8$, are generally too stable to act as effective bleaching agents. The rate of hydrolysis of peroxydisulfate to form the more reactive peroxymonsulfate is generally too slow to provide useful quantities of the latter under typical conditions of use in laundry functions. This is so even though such stability is desireable with respect to the shelf-life of the active oxygen.

A bleach composition effective at temperatures of from 40° to 55° C. is disclosed in U.S. Pat. No. 3,773,673. The bleach composition comprising a synergistic mixture of a persulfate and an organic peroxy compound in proportions such that the weight ratio of available oxygen derived from the persulfate to that derived from the organic peroxy compound is up to 3:1.

Activators are added to increase the action of a bleaching composition for low temperatures. U.S. Pat. No. 3,957,670 discloses a solid oxidizing and bleaching composition which contains an acylated oxamide as an activator for inorganic per-compounds, such as hydrogen peroxide or perborates, perphosphates, persilicates, persulfates and alkali metal peroxides.

Enzymes can also be used as activators for various compounds to release peroxides as bleaching agents. U.S. Pat. No. 4,421,668 discloses a liquid bleach composition comprising an alcohol oxidase enzyme and the corresponding alcohol which, upon interaction, forms a peroxide. U.S. Pat. No. 3,666,399 discloses a bleach composition containing a peroxydiphosphate and a phosphatase enzyme, which, upon the addition of water, forms a peroxymonophosphate.

None of the above references disclose the present invention of a bleach composition formed by the interaction of a sulfatase enzyme and a peroxydisulfate.

SUMMARY OF THE INVENTION

The present invention is a composition comprising a sulfatase enzyme and a peroxydisulfate ion ($S_2O_8^{-2}$) forming compound which hydrolyses to provide a more reactive-oxygen-containing peroxymonosulfate ion ($HSO_5^-$) when in aqueous solutions in the presence of the enzyme.

In another aspect of this invention there is provided detergent compositions comprising a detergent surfactant, a sulfatase enzyme and a peroxydisulfate. Any number of detergent surfactants may be employed including anionic, and nonionic types as well as zwitterionic varieties.

In yet another aspect of this invention there is provided a method of bleaching articles by means of contacting the article with an aqueous, solution containing a sulfatase enzyme and a peroxydisulfate.

DETAILED DESCRIPTION OF THE INVENTION

The sulfatase enzyme of the present invention can be any sulfatase that, upon interaction in aqueous solution with a peroxydisulfate, accelerates the hydrolysis to form peroxymonosulfate. Examples of such sulfatases include Type H-5 from Helix Pomatia, Type H-2 crude solution from Helix Pomatia, Type H-1 powder from Helix Pomatia, Type VIII from Abalone entrails, Type V from Limpets, and Type IV from Limpets. Not all sulfatases are effective in the present invention, such as Type VII from abalone entrails and Type VII from Aerobacter Aerogenes. A simple bleaching activity test described below can be used to determine the effectiveness of a particular sulfatase in the present invention. It is intended that the scope of this invention include synthetic and bioengineered sulfatases, as well as sulfatases isolated from naturally occurring sources.

The peroxydisulfate of the present invention is a peroxydisulfate, which, upon dissolving in water, forms the ion $S_2O_8^{-2}$. Examples of suitable peroxydisulfate compounds include potassium peroxydisulfate, sodium peroxydisulfate, as well as other soluble, stable peroxydisulfate salts such as lithium and magnesium salts.

The amount of sulfatase used in the present invention is sufficient to significantly catalyze the hydrolysis (±5%) of the peroxydisulfate to form the monosubstituted peroxide which is a more effective but less stable bleaching agent. Typically, the required ratio of sulfatase to peroxydisulfate is dependent upon the activity of the enzyme. Preferably sufficient enzyme is employed to catalyze the hydrolysis of 10% or more of the peroxydisulfate to the peroxymonosulfate.

The bleach composition of the present invention should be present in the bleaching solution at a concentration sufficient to provide in the range of 1 to 100 ppm by weight of total available oxygen in the wash water. Below about 1 ppm, little bleaching effect is observed. Above about 100 ppm, the bleaching activity may damage fabric or dyes.

The effective range of pH of the wash water for the present bleach composition is wide, and can vary from about 4.0 to 11.0. A preferred range of pH is from about 5.0 to about 9.0. Little difference in effectiveness of the composition is observed in this range.

The present bleach composition is particularly effective in cooler washing temperatures, such as below 40° C. A preferred wash temperature is ambient temperature, i.e., from about 20° to about 30° C.

The bleach composition of the present invention can be used in the presence of compatible water soluble organic detergent surfactants to provide a detergent composition. The composition can contain other ingredients such as inorganic builder salts and/or organic sequestrant builder salts. Particularly suitable organic detergents are the anionic detergents such as soap, alkylaryl sulfonates, fatty acid isothionates and fatty acyl taurides. A particularly preferred detergent surfactant is a linear alkyl benzene sulfonate. A preferred alkyl benzene sulfonate is one having from 10 to 14 carbon atoms in the alkyl portion. Nonionic and zwitterionic surfactants which are substantially unaffected in solution by the bleaching agents can also be used. Sulfate ester surfactants are least preferred because they may be hydrolyzed by the sulfatase enzyme.

The level of detergent surfactant that can be employed is from 0% to about 50%, preferably from about 1% to about 30% and most preferably from about 10% to about 25% by weight of the total composition.

In addition to detergent surfactants, detergency builders can be employed in the bleaching compositions. Water-soluble inorganic or organic electrolytes are suitable builders. The builder can also be water-insoluble calcium ion exchange materials; nonlimiting examples of suitable water-soluble, inorganic detergent builders include: alkali metal carbonates, borates, phosphates, bicarbonates and silicates. Specific examples of such salts include sodium and potassium tetraborates, bicarbonates, carbonates, orthophosphates, pyrophosphates, tripolyphosphates and metaphosphates.

Examples of suitable organic alkaline detergency builders include: (1) water-soluble amino carboxylates and aminopolyacetates, for example, nitrilotriacetates, glycinates, ethylenediamine, tetraacetates, N-(2-hydroxyethyl)nitrilo diacetates and diethylenetriamine pentaacetates; (2) water-soluble salts of phytic acid, for example, sodium and potassium phytates; (3) water-soluble polyphosphates, including sodium, potassium and lithium salts of ethane-1-hydroxy-1, 1-diphosphonic acid; sodium, potassium, and lithium salts of ethylene diphosphonic acid; and the like; (4) water-soluble polycarboxylates such as the salts of lactic acid, succinic acid, malonic acid, maleic acid, citric acid, oxydisuccinic acid, carboxymethyloxysuccinic acid, 2-oxa-1,1,3-propane tricarboxylic acid, 1,1,2,2-ethane tetracarboxylic acid, mellitic acid and pyromellitic acid; and (5) water-soluble polyacetals as disclosed in U.S. Pat. Nos. 4,144,266, 4,246,495 and 4,663,071 incorporated herein by reference.

Another type of detergency builder material useful in the present compositions comprises a water-soluble material capable of forming a water-insoluble reaction product with water hardness cations preferably in combination with a crystallization seed which is capable of providing growth sites for said reaction product. Such "seeded builder" compositions are fully disclosed in British Pat. No. 1,424,406.

A further class of detergency builder materials useful in the present invention are insoluble sodium aluminosilicates, particularly those described in Belgian Pat. No. 814,874, issued Nov. 12, 1974, incorporated herein by reference. This patent discloses and claims detergent compositions containing sodium aluminosilicates having the formula:

$$Na_{12}(SiO_2AlO_2)_{12}27H_2O$$

The level of detergency builder of the bleaching compositions is from 0% to about 70%, preferably from about 10% to about 60% and most preferably from about 20% to about 60%.

Non-phosphate builders such as ether carboxylates are preferred because polyphosphates may, in some instances, act as inhibitors for sulfatase enzymes. In cases where moisture or other components of the detergent composition might interact undesirably with the solid bleaching agents, it is possible to take precautions to minimize contact between the bleach composition and other components of the detergent composition by pelletizing or granulating the agents individually or together. This considerably reduces the area of contact between the bleach composition and the other components. Alternatively, the bleach composition or other components can be coated with an inert protective material which is removed by solution, melting or abrasion in the washing process.

The detergent compositions or bleach composition can contain other compatible minor ingredients commonly employed in such compositions, such as soil suspending agents, for example carboxymethyl cellulose; copolymers of methylvinylether and maleic anhydride and other water soluble polymeric substances; suds controlling agents, such as fatty acid ethanolamides; or nonionic detergents, high molecular weight saturated fatty acids or their soaps; optical brighteners; tarnish inhibitors; proteolytic, amylolytic or lipolytic enzymes; dyes; perfume; and the like.

It is preferred to incorporate the bleach composition in proportions such that when the detergent is used at the usual and proper concentration for satisfactory washing, the concentration of available oxygen in the solution is in the ranges described above. In conventional heavy duty household detergents an available oxygen content can be in the range of from about 1 to about 30 ppm in the wash solution.

The following examples are for illustrative purposes and are not designed to limit the present invention in any way.

EXPERIMENTAL

Varying the Type of Enzyme

The controls and examples given in Tables 2 and 3 show the effect of varying the type of enzyme used in combination with potassium peroxydisulfate. The tested enzymes are available from laboratory supply companies and are summarized below in Table 1.

TABLE 1

| Tested Enzymes | | |
|---|---|---|
| Enzyme | Description | Activity Level* |
| S1 | Type H-5 from Helix Pomatia | 15–40 |
| S2 | Type VII from Abalone Entrails | 30–50 |
| S3 | Type VII from Aerobacter Aerogenes | 2–5 |
| S4 | Type H-2 crude solution from Helix Pomatia | 2000–5000 |
| S5 | Type H-1 powder from Helix Pomatia | 15–40 |
| S6 | Type VIII from Abalone Entrails | 20–40 |
| S7 | Type V from Limpets | 5–15 |
| S8 | Type IV from Limpets | 10–25 |

*Activity Level is given in units/mg except S4 which is given in units/ml of solution.

The procedure for testing the enzymes included preparing the following solutions using deionized water.

Solutions (A) 0.020 g/l of Crystal Violet, 500 ml, pH 5.5.
(B) 0.440 g/l $K_2S_2O_8$, 250 ml.
(C) 0.440 g/l Oxone (registered trademark), 250 ml.
(D) 0.240 g/l $NaBO_3.4H_2O$, 250 ml.

Testing S1, S2 and S3

Nine vials were prepared containing 25 ml of solution A, and the following additional ingredients indicated in Table 2. The observation values under each elapsed time indicate the color level in the solution. A "0" value indicates the highest level of color intensity, or no change from the untreated dye color. A "5" value indicates a completely clear solution, and the intermediate numbers indicate gradations between "no change" to clear.

TABLE 2

Testing S1, S2 and S3

| Run No. | Ingredients | Observations Elapsed Times (h) 2.0 | 3.75 | 21.0 |
|---|---|---|---|---|
| 1 | 5 ml $H_2O$ | 0 | 0 | 0 |
| 2 | 5 ml B | 0 | 0 | 2.0 |
| 3 | 5 ml B, 7 mg S1 | 2.0 | 3.5 | 4.5 |
| 4 | 5 ml $H_2O$, 7 mg S1 | 0 | 0 | 0 |
| 5 | 5 ml B, 1.4 mg S2 | 0 | 0 | 1.5 |
| 6 | 5 ml $H_2O$, 1.4 mg S2 | 0 | 0 | 0 |
| 7 | 5 ml B, 0.9 mg S3 | 0 | 0 | 1.5 |
| 8 | 5 ml $H_2O$, 0.9 mg S3 | 0 | 0 | 0 |
| 9 | 5 ml Oxone | 2.0 | 2.0 | 3.5 |

As can be seen from the observations summarized in Table 2, the most effective enzyme in a bleach composition in combination with potassium peroxydisulfate was S1 (Run No. 3). The use of S2 and S3 (Run Nos. 5 and 7) was less effective in bleaching in this test.

In Table 3, tests similar to those run for Table 2 were made, evaluating enzymes S4 through S8.

TABLE 3

| Run No. | Ingredients | Observations Elapsed Times (h) 3.0 | 5.0 | 22.0 |
|---|---|---|---|---|
| 1 | 5 ml $H_2O$ | 0 | 0 | 0 |
| 2 | 5 ml B | 2.0 | 2.0 | 3.0 |
| 3 | 5 ml $H_2O$, 7 mg S1 | 1.0 | 1.0 | — |
| 4 | 5 ml B, 7 mg S1 | 3.5 | 4.0 | 4.0 |
| 5 | 5 ml D | 4.5 | 5.0 | 5.0 |
| 6 | 5 ml C | 4.0 | 5.0 | 5.0 |
| 7 | 5 ml $H_2O$, 0.1 ml S4 | 0 | 0 | 1.0 |
| 8 | 5 ml B, 0.1 ml S4 | 3.0 | 3.5 | 4.0 |
| 9 | 5 ml $H_2O$, 7 mg S5 | 0 | 0 | 1.0 |
| 10 | 5 ml B, 7 mg S5 | 4.0 | 4.5 | 5.0 |
| 11 | 5 ml $H_2O$, 7 mg S6 | 0 | 0 | 0 |
| 12 | 5 ml B, 7 mg S6 | 3.5 | 4.0 | 5.0 |
| 13 | 5 ml $H_2O$, 10 mg S7 | 0 | 0 | 0 |
| 14 | 5 ml B, 10 mg S7 | 3.5 | 3.5 | 4.0 |
| 15 | 5 ml $H_2O$, 3.5 mg S8 | 0 | 0 | 0 |
| 16 | 5 ml B, 3.5 mg S8 | 3.5 | 3.5 | 5.0 |

As can be seen in Run Nos. 8, 10, 12, 14 and 16, enzymes S4 through S8 are effective for forming an enhanced bleach composition in this test.

The Effect of Varying pH

The effect of varying the pH of the solution was tested by adjusting the pH of solutions A, B and C (above) to 5.0 with acetic acid, and to 7.0 and 9.0 with sodium carbonate. Seven vials were prepared containing 25 ml of solution A at the indicated pH, and the following indicated additional ingredients.

TABLE 4

Testing at pH 5.0

| Run Nos. | Ingredients | Observations Elapsed Times (h) 2.3 | 5.3 | 22.5 |
|---|---|---|---|---|
| 1 | 5 ml $H_2O$ | 0 | 0 | 0 |
| 2 | 5 ml B | 0 | 0 | 1.0 |
| 3 | 5 ml $H_2O$, 7 mg S1 | 0 | 0 | 0 |
| 4 | 5 ml B, 3 mg S1 | 2.5 | 4.0 | 4.5 |
| 5 | 5 ml B, 5 mg S1 | 3.0 | 4.0 | 4.5 |
| 6 | 5 ml B, 7 mg S1 | 3.5 | 4.0 | 4.5 |
| 7 | 5 ml C | 3.5 | 4.5 | 5.0 |

The above data indicates an increase in the rate of bleach effect with increase in concentration of Enzyme S1. Tests conducted at pH 7.0 and 9.0, provided results which were essentially the same as shown above, indicating little effect in varying the pH.

Varying the Temperature

The effect of varying the temperature was determined by preparing two vials containing 25 ml Solution A, pH adjusted to 7.0 with sodium carbonate, 5 ml Solution B and 0.7 ml S1. One vial was kept at ambient temperature (25° C.) and the other vial was kept at 43° C. The sample at ambient temperature, was almost clear after (rating of 4.5) 19.5 h. The sample at 43° C., showed more color (rating of 3.5) than the one held at ambient temperature, indicating that this bleaching system is more effective at cooler temperatures. Higher temperature appears to harm the enzyme activity.

Testing Stained Fabric

The effect of the present bleaching system on crystal violet stained fabric was tested as follows. Three cotton swatches were stained with crystal violet dye and rinsed thoroughly to remove excess stain. Each swatch was cut into three pieces and marked. One of each of the three swatches was kept untreated as a control. The remaining two pieces were treated as follows.

TABLE 5

| Run Nos. | Ingredients | Observations Elapsed Times (h) 1.0 | 5.0 | 21.5 |
|---|---|---|---|---|
| 1 | 25 ml $H_2O$, 5 ml A | 0 | 0 | 1.0 |
| 2 | 25 ml $H_2O$, 5 ml A, 7 mg S1 | 0 | 2.5 | 4.0 |
| 3 | 25 ml $H_2O$, 5 ml D | 0 | 0 | 1.5 |

The Run No. 2 above was effective in bleaching the fabric, while controls Run Nos. 1 and 3 above were relatively ineffective. Run No. 3 above contained a solution of sodium perborate, a commonly used bleach.

Safeness Testing

The safeness of the bleaching system was tested using the dye fading misuse test on Reactive Red 21 and Immedial Green dyed cotton fabrics as follows. Bleach and commercially available detergent mixtures were formulated as described below. The indicated amount of each mixture was poured onto fabric to form a small mound in the center of the dyed fabric. 5 ml of deionized water was poured onto each mound, and the mixture allowed to sit for ten minutes. Each swatch was then thoroughly rinsed and allowed to air dry before being rated according to the following guidelines.

1. Complete destruction of dye at any point.

2. Severe damage of the dye at any point.
3. Noticeable dye fading at any point.
4. Slight dye fading at any point.
5. No change.

TABLE 6

| Run Nos. | Ingredients | Amount | Observations Red 21 | Immedial Green |
|---|---|---|---|---|
| 1 | $NaBO_3.H_2O$, | 0.02 g | 4 | 5 |
| 2 | Detergent, | 0.3 g | 5 | 5 |
| 3 | Control | (no treatment) | 5 | 5 |
| 4 | 1.5 g Detergent and 0.07 g $K_2S_2O_8$, | 0.3 g | 4 | 4 |
| 5 | 1.5 g Detergent, 0.07 g $K_2S_2O_8$ and 0.17 g S1, | 0.3 g | 4 | 4 |
| 6 | 1.5 g Detergent and 0.07 g Oxone | 0.3 g | 1 | 1 |

The control Containing Oxone Run No. 6 showed excessive damage to the dyes. Control Run 1, 2 and Test Run No. 5 showed some damage (slight fading) to the dye. A comparison of results of Runs 4, 5 and 6 above shows that the peroxymonopersulfate produced in situ in Run 5 is far less damaging to dye than premade peroxymonopersulfate contained in Oxone.

Textile Bleaching Performance

In all of the tests below a detergent is employed as a control at a use level of 1.5 g/L of wash solution. Various bleach compounds of this invention were added to portions of the detergent composition in the amounts shown below in the tables. Each test series contained a control. The detergent formulation is as follows:

| Ingredient | Weight % |
|---|---|
| Sodium alkyl benzene sulfonate | 16 |
| Sodium carbonate | 10 |
| Sodium silicate (47% solids) | 9 |
| Water | 8 |
| Carboxymethyl cellulose | 1 |
| Sodium sulfate | 24 |
| Sodium tripolyphosphate | 32 |

All of the examples below were conducted at the same wash conditions of 25° C. and with water having a hardness level of 150 ppm (3:2) mole ratio of calcium to magnesium calculated as calcium carbonate). In each test a set of three swatches were evenly stained with a test solution. After staining the light reflectance value ($Rd_i$) was measured using the Gardner XL-23 Tristimulator Colorimeter manufactured by Gardner Laboratory, Inc., Bethesda, Md.

A Terg-o-tometer was employed to test the bleaching performance of the bleach compounds. In each test three stained swatches together with three unstained swatches were placed in a cylindrical container with 1 liter of water and 1.5 g of detergent together with a weighed amount of a bleach compound of this invention. The pH of the was solution was adjusted to 9.0 with boric acid. Two minutes were allowed for the detergent to dissolve. The washing operation covered a period of 15, 30 and 60 minutes after which the laundered swatches were rinsed with clear water and dried. Light reflectance measurements of each cleaned dried switch were made and averaged ($Rd_f$). The difference, ($\Delta Rd$) of these readings was then employed to determine the percent stain removal according to the formula:

$$\frac{\Delta Rd}{100 - Rd_f} \times 100 = \text{percent stain removal}$$

TABLE 7

| Run Nos. | Ingredients | % Tea Stain Removal Wash Time (h) 0.25 | 0.50 | 1.0 |
|---|---|---|---|---|
| 1 | Control | 6.5 | 8.5 | 9.3 |
| 2 | 0.116 g S1 | 6.7 | 7.2 | 8.1 |
| 3 | 0.09 g $K_2S_2O_8$ | 7.2 | 8.5 | 9.2 |
| 4 | 0.09 g $K_2S_2O_8$ and 0.116 g S1 | 7.7 | 8.6 | 10.6 |

There were no significant differences in the effectiveness of each treatment shown in Table 7.

Similar testing was done as described above for tea stains, except that the stains were blood, wine, grass, coffee and again tea. Detergent was omitted and the tests were run in deionized water. 30 ml vials were used, and 1.3"×3.0" swatches were employed. To each vial was added:

I-30 ml $H_2O$
II-25 ml $H_2O$ and 5 ml $NaBO_3.4H_2O$ (0.06 g/250 ml)
III-25 ml $H_2O$ and 5 ml $K_2S_2O_8$ (0.11 g/250 ml)
IV-25 ml $H_2O$ and 5 ml $K_2S_2O_8$ (0.11 g/250 ml) and 7 mg S1.

The swatches were treated for one hour, five hours and eighteen hours. A swatch of each stain was left untreated as a control. The results of the testing indicated that for wine stains and tea stains the perborate solution (II) was slightly better than the other treatments. The remaining treatments were essentially the same. For blood stains, the present invention (IV) was noticeably better than the other treatments. For coffee stains and grass stains, all treatments were about the same in effectiveness.

We claim:

1. A bleach composition comprising a sulfatase enzyme and a stable, water soluble peroxydisulfate ion forming compound which, in the presence of the enzyme, hydrolyses in aqueous solution to provide peroxymonosulfate ions.

2. A bleach composition of claim 1 wherein the sulfatase enzyme is selected from the group consisting of Type H-5 from Helix Pomatia, Type H-2 from helix pomatia, Type H-1 powder from Helix Pomatia, Type VIII from Abalone Entrails, Type V from Limpets and Type IV from Limpets.

3. A bleach composition of claim 1 wherein the peroxydisulfate is a salt wherein the cation is selected from the group consisting of potassium, sodium, lithium and magnesium.

4. A detergent composition comprising a detergent surfactant and a bleach effective amount of a composition of claim 1.

5. A composition of claim 4 further including a detergent builder.

6. A composition of claim 5 wherein the detergent builder is an ether carboxylate.

7. A composition of claim 5 wherein the detergent builder is a polycarboxylate.

8. A composition of claim 7 wherein the polycarboxylate is a polymeric acetal carboxylate.

9. A composition of claim 5 wherein the detergent builder is a mixture of ether carboxylates.

10. A composition of claim 9 wherein the mixture of ether carboxylates comprises 1-hydroxy-3-oxa-1,2,4,5-pentanetetracarboxylate and hexa-sodium 3,6-dioxa-1,2,4,5,7,8-octanehexacarboxylate.

11. A composition of claim 4 wherein the detergent surfactant is a linear alkyl benzene sulfonate having from 10 to 14 carbon atoms in the alkyl portion.

12. A bleach composition comprising an aqueous solution of a sulfatase enzyme and a stable, water soluble peroxydisulfate ion forming compound which, in the presence of the enzyme, hydrolyses in aqueous solution to form peroxymonosulfate ions.

13. The composition of claim 12 wherein the pH is in the range of from about 4 to about 11.

14. A composition of claim 12 wherein the pH is in the range of from about 5 to about 9.

15. A process of bleaching articles which comprises contacting the article with a bleach effective amount of an aqueous composition comprising a sulfatase enzyme and a stable, water soluble peroxydisulfate ion producing compound which, in the presence of the enzyme, hydrolyses in aqueous solution to form peroxy-monosulfate ions.

16. A process of claim 15 wherein the sulfatase enzyme is selected from the group consisting of Type H-5 from Helix Pomatia, Type H-2 from helix pomatia, Type H-1 powder from Helix Pomatia, Type VIII from Abalone Entrails, Type V from Limpets and Type IV from Limpets.

17. A process of claim 15 wherein the peroxydisulfate ion forming compound is a salt wherein the cation is selected from the group consisting of potassium, sodium, lithium and magnesium.

18. The process of claim 15 wherein the pH is in the range of from about 4 to about 11.

19. A process of claim 15 wherein the composition further comprises a detergent surfactant.

20. A process of claim 19 wherein the composition further includes a detergent builder.

21. A process of claim 20 wherein the detergent builder is an ether carboxylate.

22. A process of claim 20 wherein the detergent builder is a polycarboxylate.

23. A process of claim 22 wherein the polycarboxylate is a polymeric acetal carboxylate.

24. A process of claim 21 wherein the detergent builder is a mixture of ether carboxylates.

25. A process of claim 24 wherein the mixture of ether carboxylates comprises 1-hydroxy-3-oxa-1,2,4,5-pentanetetracarboxylate and hexa-sodium 3,6-dioxa-1,2,4,5,7,8-octanehexacarboxylate.

26. A process of claim 15 wherein the pH is in the range of from about 5 to about 9.

27. A process of claim 19 wherein the detergent surfactant is a linear alkyl benzene sulfonate having from 10 to 14 carbon atoms in the alkyl portion.

* * * * *